US009315298B2

(12) United States Patent
Brataas

(10) Patent No.: US 9,315,298 B2
(45) Date of Patent: Apr. 19, 2016

(54) ACCESSORY BAG HAVING REINFORCED SIDEWALLS AND VARIABLE LENGTH

(75) Inventor: Truls Kristian Brataas, Oslo (NO)

(73) Assignee: DB EQUIPMENT AS, Oslo (NO)

( * ) Notice: Subject to any disclaimer, the term of this patent is extended or adjusted under 35 U.S.C. 154(b) by 0 days.

(21) Appl. No.: 14/240,933

(22) PCT Filed: Aug. 17, 2012

(86) PCT No.: PCT/IB2012/001599

§ 371 (c)(1),
(2), (4) Date: Feb. 25, 2014

(87) PCT Pub. No.: WO2013/027104

PCT Pub. Date: Feb. 28, 2013

(65) Prior Publication Data

US 2014/0212071 A1 Jul. 31, 2014

Related U.S. Application Data

(60) Provisional application No. 61/527,332, filed on Aug. 25, 2011.

(51) Int. Cl.

| | |
|---|---|
| ***B65D 30/00*** | (2006.01) |
| ***B65D 33/16*** | (2006.01) |
| ***A45C 5/14*** | (2006.01) |
| ***A45C 7/00*** | (2006.01) |
| ***A63C 11/02*** | (2006.01) |

(52) U.S. Cl.

CPC . *B65D 33/16* (2013.01); *A45C 5/14* (2013.01); *A45C 7/0036* (2013.01); *A45C 7/0077* (2013.01); *A63C 11/026* (2013.01)

(58) Field of Classification Search

CPC ..... A45C 7/0063; A45C 7/0077; A45C 7/00; A45C 3/00

USPC ..... 383/2, 13, 14, 30, 31, 119, 89, 90, 4, 383/17, 18, 20; 190/103, 116, 115, 117; 150/107, 110; 206/315.1, 315.3, 315.8; 294/154, 157

See application file for complete search history.

(56) References Cited

U.S. PATENT DOCUMENTS

| | | | | | |
|---|---|---|---|---|---|
| 1,561,122 | A | * | 11/1925 | Stahl | 280/35 |
| 2,436,237 | A | * | 2/1948 | Brandt | A45C 3/06 150/105 |
| 4,358,137 | A | | 11/1982 | Gramm | |
| 4,657,135 | A | * | 4/1987 | Kjose | 206/315.3 |
| 4,805,749 | A | * | 2/1989 | Gerch | 190/111 |
| 4,830,154 | A | * | 5/1989 | Gerch | A45C 3/00 190/103 |

(Continued)

FOREIGN PATENT DOCUMENTS

WO WO 2007/058551 A1 5/2007

*Primary Examiner* — Jes F Pascua

(74) *Attorney, Agent, or Firm* — Birch, Stewart, Kolasch & Birch, LLP

(57) ABSTRACT

An accessory bag includes a bottom wall, a front wall and a back wall. The wall is made of flexible material. A pair of side walls extends between the front wall and back wall. A first pair of connection rails extends along the front wall. A second pair of connection rails extends along the back wall. A connection handle includes a first end and a second end. A first connector on the first end is configured to cooperate with the first pair of pair of connection rails. A second connector on the second end is configured to cooperate with the second pair of connection rails. In addition, the connection handle includes a handle.

20 Claims, 7 Drawing Sheets

(56) References Cited

U.S. PATENT DOCUMENTS

| | | | | |
|---|---|---|---|---|
| 5,244,219 | A * | 9/1993 | Hadlum | 280/47.26 |
| 5,265,894 | A * | 11/1993 | Dunn | 280/47.26 |
| 6,244,399 | B1 * | 6/2001 | Birkestrand | 190/103 |
| 6,401,890 | B1 * | 6/2002 | Tan | 190/107 |
| 6,463,604 | B1 * | 10/2002 | Reveron et al. | 5/413 R |
| 6,859,960 | B1 | 3/2005 | Jerome | |
| 6,926,129 | B2 * | 8/2005 | Hoberman | 190/107 |
| 7,188,714 | B1 * | 3/2007 | Herold | 190/18 A |
| 7,424,950 | B2 * | 9/2008 | Burgess et al. | 206/315.3 |
| 8,302,641 | B2 * | 11/2012 | Nelson | A45C 1/024 150/103 |
| 2002/0104725 | A1 | 8/2002 | Dexheimer | |
| 2004/0045780 | A1 * | 3/2004 | Bernbaum et al. | 190/109 |
| 2005/0178631 | A1 * | 8/2005 | Fenton | A45F 5/10 190/109 |
| 2006/0289588 | A1 | 12/2006 | Lindberg | |
| 2011/0083933 | A1 | 4/2011 | Engel | |

* cited by examiner

ACCESSORY BAG HAVING REINFORCED SIDEWALLS AND VARIABLE LENGTH

This application claims benefit of provisional application 61/527,332, filed Aug. 25, 2011, the contents of which are hereby incorporated by reference.

FIELD OF THE INVENTION

The invention relates to accessory bags for items such as sporting equipment.

BACKGROUND OF THE INVENTION

Sports equipment that is being transported with existing non-adjustable bags serves as the substructure of the bag's bottom structure. The substructure of the bag disappears when the equipment inside the bag is shorter than the total length of the bag. This results in a non-linear bag structure. Therefore, the bag will be partly dragged with the fabric against the ground rather than rolling on wheels attached to the bag. This results in high wear on the fabric and more difficult transportation of the bag for the user. This problem is common among skiers and snowboarders because skies and snowboards come in all varieties of length, but existing non-adjustable ski and snowboard bags only come in a few lengths options.

Protection of the gear is the most important function for a sports equipment bag. The gear inside the bag is often highly expensive and is not designed for the stress that may occur during transportation. Weight is a key factor for traveling with sports equipment on airplanes. Weight limitations are becoming increasingly strict, and overweight fees can be extensively high. Protection and weight are two factors that are not addressed very well in existing products.

Accessory bags for sports equipment, such as skis and snowboards must be able to protect the contents, especially if the bags are going to be used to transport equipment on commercial airline flights, where checked bags are subjected to automated machinery. If the overall length of the bag is greater than the equipment stored inside, the equipment can move within the bag, increasing the likelihood of damage. Moreover, accessory bags take up too much space when not being used.

It is an object of the invention to provide an accessory bag having an adjustable length for the transportation of variable length equipment.

It is another object of the invention to provide an accessory bag having reinforced side walls adding protection for the contents without interfering with the ability for the bag to be rolled.

It is yet another object of the invention to provide an accessory bag having a connection handle maintaining the bag in position when partially or fully rolled and also providing a handle for facilitating transport of the bag.

These and other objects of the invention will become apparent to one of ordinary skill in the art after reading the following disclosure of the invention.

SUMMARY OF THE INVENTION

The length adjustment system includes two main components; the connection rails and the connection handle. The connection rails include two parallel lines of webbing along the whole length of the bag on both the top and bottom of the bag. This webbing has sewed-in loops that make it possible to fasten the buckles that are placed on the connection handle anywhere along the connection rail.

The connection handle includes a handle, two lines of webbing and four buckles. The webbing is fastened to the handle at the sides matching the width of the connection rails. Two buckles are sewed on to the webbing on both sides close to the handle. These two buckles are non-adjustable and make up the part of the handle that will be connected to the connection rails on the bottom of the bag. These two buckles are permanently fixed to the webbing by, for instance, sewing the buckle within a loop formed at the end of the webbing. In this way, the buckle cannot fall off of the webbing or be taken off of the webbing by the user. The other two buckles are attached to the webbing on the other side of the handle. The webbing on this side is much longer, and the buckles are adjustable and can slide along the webbing. These two buckles will be attached to the connection rail on the topside of the bag. All four buckles have a hook function like found on bouldering pads and carabineers.

When equipment is placed inside the bag, the front of the bag is rolled in to the desired length. The two non-adjustable buckles on the connection handle are then attached to two corresponding loops on the bottom connection rails. The two adjustable buckles on the connection handle are then attached to two corresponding loops on the top connection rails. The adjustable buckles on the connection handle are then tightened so that the webbing on the handle creates tension in both the fabric on the top of the bag through the top connection rails, and tension in the fabric on the bottom through the bottom connection rails. This tension holds the rolled up fabric in place and creates a rigid structure.

Increased protection results from a three-stage rib construction that is implanted in both the sidewalls and the bottom structure of the bag. When the length adjustment system is tightened, it is designed to create tension in the fabric on the top and the bottom structure of the bag. The tension on the top (transferred through the top connection rails) causes the vertical sidewalls with built in protection ribs to rise up and create a protection cage for the equipment that is inside the bag. The tension that goes to the bottom structure (transferred through the bottom connection rails) tightens the horizontal ribs close to the equipment and creates protection against impact from below. This protective three-stage rib construction creates a protection cage for the equipment that is inside the bag. This cage will hold the same shape creating the same level of protection regardless of whether the bag it fully packed or not. The three-stage rib construction offers extensive protection at very low weight. This allows a significant reduction in fabric and padding, which result in a lower production cost and a lower total weight for products.

The length adjustment system will always provide a rigid and stiff substructure due to the perfect fit. This allows the wheels on the bag to be in contact with the ground at all times and prevents the occurrence of a non-linear collapsed bag where the bag will be partly dragged with the fabric against the ground rather than rolling on the wheels.

The three-stage rib construction allows both of the sidewalls to collapse onto the bottom wall when the bag is empty. When the sidewalls are folded down, the bag can be rolled in all the way, making the bag look like a compressed cylinder. The connection handle provides additional compression and holds the bag in its cylindrical shape. It also provides a handle to carry the compressed bag.

The length adjustment three-stage rib construction creates accessory bags that can be used for several types of equipment, including sport equipment such as skies, snowboards, wakeboards, kiteboards and surfboards. However, it should be understood that this invention can also be used for equipment in other industries.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
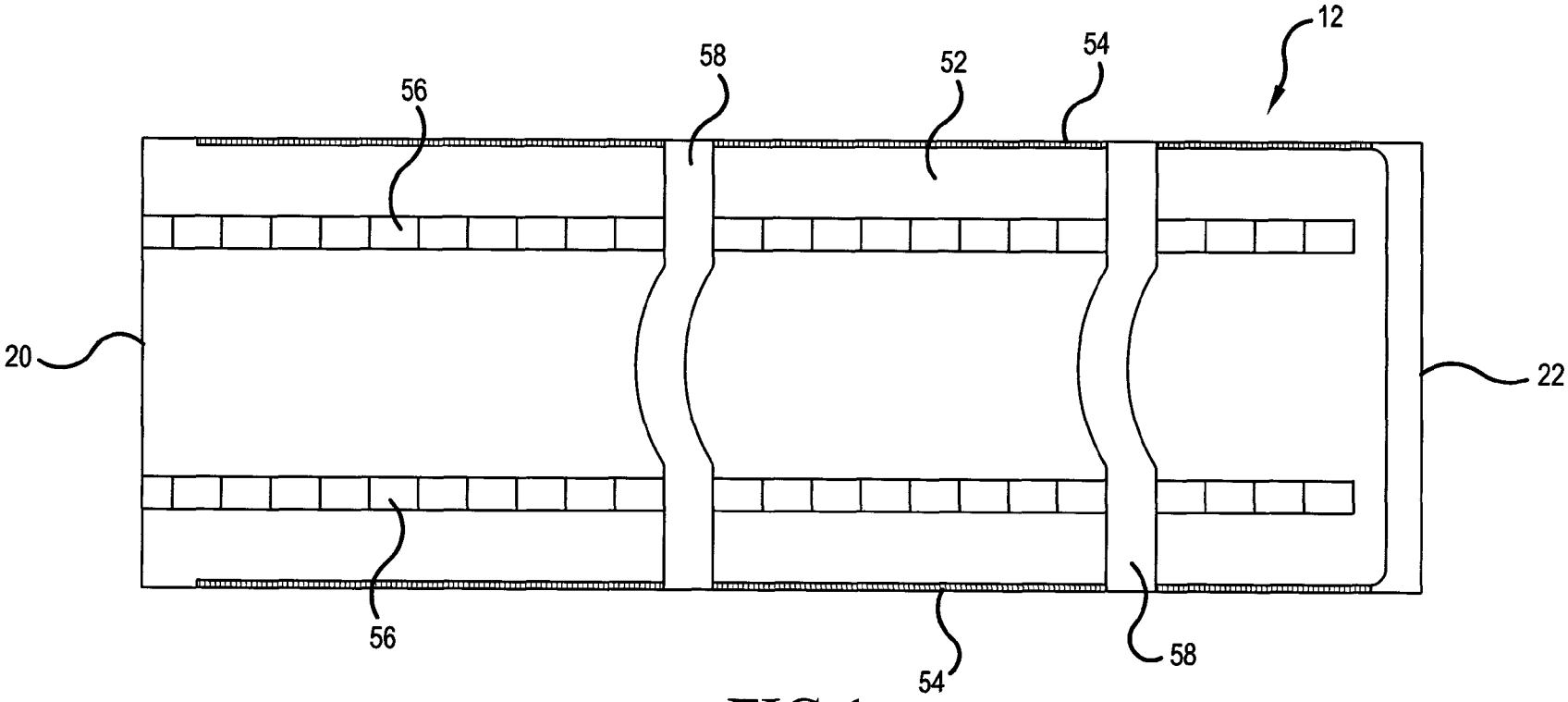
FIG. 1 is a front view of the accessory bag.

The present invention will now be described with reference to the accompanying drawings, wherein the same or similar elements are identified with the same reference numeral.

The front wall 12 of the accessory bag is depicted in FIG. 1. The front wall 12 is formed by a front panel 52 secured to the sides of the bag by a pair of zippers 54. The zippers allow the front panel 52 to be pulled back to provide access to the interior of the accessory bag. A pair of handles 58 may extend across the top of the front panel 52. The handles 58 provide an easy grasping point when the accessory bag is lifted in the unfolded state. The handles 58 extend across the front panel 52 and may be formed by straps that are secured to the side walls of the bag. A pair of connection rails 56 extends along the length of the front wall 12. The connection rails 56 are formed by a strip of material forming loops, allowing for the easy attachment of a connection handle 40 (see FIG. 8) anywhere along the length of the front panel 52, as will also be explained later.

Figure 2:
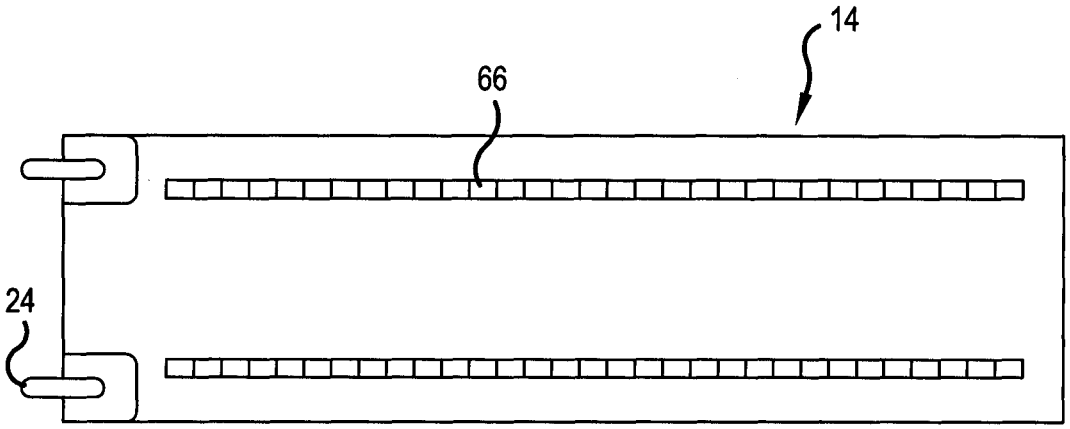
FIG. 2 is a back view of the accessory bag.

FIG. 2 depicts the back wall 14 of the accessory bag. As seen, the bottom wall 20 of the accessory bag is provided with wheels 24 so that the accessory bag may be easily transported when in the unfolded state. The back wall 14 of the accessory bag is provided with a second pair of connection rails 66. Similar to the first pair of connection rails 56, the second pair of connection rails 66 is formed by a strip of material connected intermittently to the back wall 14 of the bag to provide loops allowing for the connection of the connection handle 40. The second connection rails 66 are placed on the back wall 14 to be aligned with the first connection rails 56 when the accessory bag is rolled.

Figure 3:
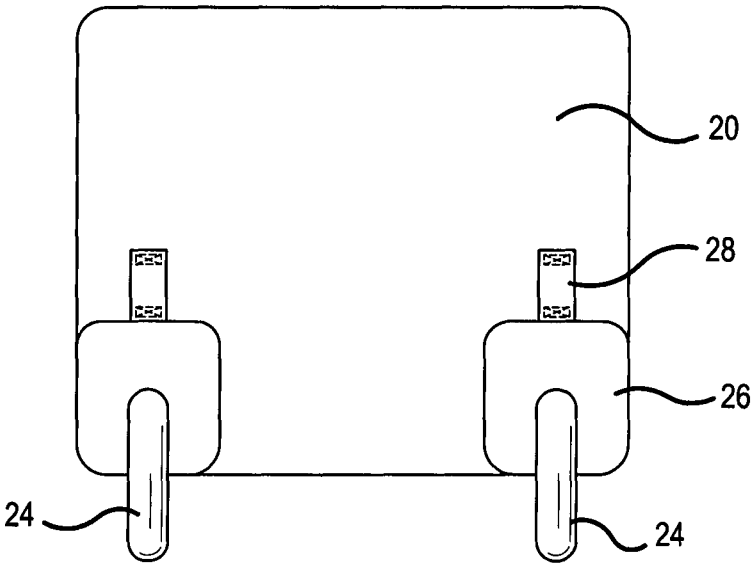
FIG. 3 is a bottom view of the accessory bag.

The bottom wall 20 of the bag is clearly seen in FIG. 3. As mentioned previously, the bottom wall 20 of the bag is provided with wheels 24 to allow easy transport of the bag. A hard plastic platform 26 provides a rigid attachment point for the wheels 24 so that the accessory bag can be wheeled across hard surfaces. The platform 24 may be L-shaped to extend along both the back wall 14 and bottom wall 20. The platform 24 may extend across the entire width of the accessory bag to provide rigidity to the corner where the bottom wall 20 meets the back wall 14. A single loop 28 is provided on each side of the bottom 20 for attachment of the connection handle 40 when the bag is in the fully rolled state, as will be explained later. The loops 28 may be made of flexible or rigid material.

The bottom 20 and/or the back wall 14 of the accessory bag could include various straps to secure the sports equipment therein. For instance, the bottom 20 and or the back wall 14 of the bag could include a pair of loops for receiving a pair of skis and for catching the bindings of the skis. When the skis are inside the accessory bag is rolled in to the desired length, starting at the top 22. Two non-adjustable buckles 48 on the connection handle 40 are then attached to two corresponding loops of the second pair of connection rails 66 on the back wall 14. The two adjustable buckles 48 on the connection handle 40 are then attached to two corresponding loops of the first pair of connection rails on the front wall 12.

Figure 4:
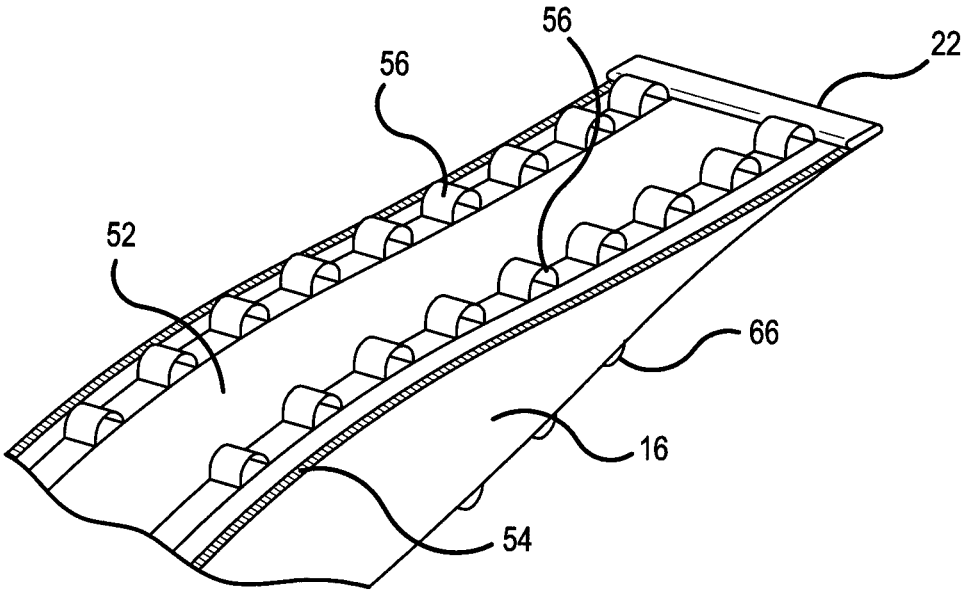
FIG. 4 is a perspective view of a top half of the accessory bag.

FIG. 4 is a perspective view of the top half of the accessory bag. The first pair of connection rails 56 are clearly seen as a strip of material selectively attached to the front panel 52 to create a series of loops extending along the length of the accessory bag. In addition, the second pair of connection rails 66 on the back wall 14 of the accessory bag are partially visible. The side walls 16 extending between the front panel 52 and the back wall 14 tapers toward the top 22. It is noted that there are two side walls 16, which are formed integrally with the back wall 14. The two side walls 16 include zippers that cooperate with the zippers 54 on the front panel 52. While the side wall may not taper and have a distinct top edge, the tapering of the bag towards the top 22 facilitates rolling of the bag from the top 22 towards the bottom wall 20.

Figure 5:
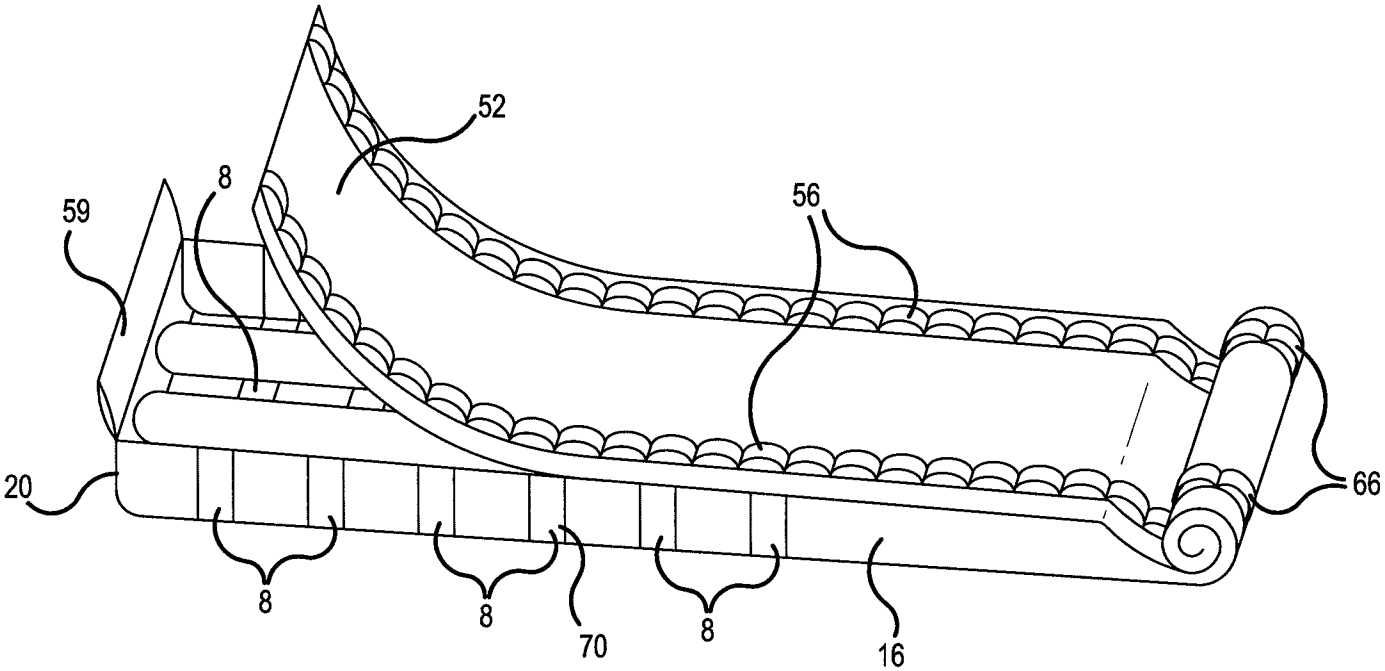
FIG. 5 is a perspective view of the accessory bag partially rolled.

FIG. 5 depicts the accessory bag with the top 22 partially rolled towards the bottom wall 20 and the front panel 52 partially open. The steps are not shown for purposes of clarity. A flap 59 connected to the bottom wall 20 of the accessory bag is seen. This flap 59 has a connector, such as a hook and loop fastener, on a front surface to cooperate with a mating connector on the outer surface of the front panel 52 to help maintain the front panel 52 in the closed position when the zippers 54 are closed. The flap may also be attached to and extend from the front panel 52 and connect to the bottom wall with mating connectors, such as a hook and loop fastener. The first connection rails 56 are clearly seen in this view. In addition, it is seen how rolling of the accessory bag exposes the second pair of connection rails 66 of the back wall 14 of the accessory bag. When rolled, the second pair of connection rails 66 on the back wall 14 align with the first pair of connection rails 56 on the front wall 12.

Also seen in the view is a plurality of pockets 70 in the side wall 16 at the bottom half of the side wall 16. The pockets retain ribs 8 to provide extra strength and rigidity to the accessory bag and, by not being provided in the top half of the side wall 16, do not interfere with the rolling of the accessory bag. Although only one rib 8 is shown in FIG. 5, the back wall 14 can also include a plurality of ribs 8 spaced along at least the bottom half of the accessory bag as well. The ribs 8 on the back wall 14 provide additional rigidity to accessory bag. It is also noted that the ribs 8 of the back wall 14 can be provided along a majority of the length of the accessory bag, since the addition of such additional ribs will not interfere with the rolling of the accessory bag from the top 22. The ribs 8 may be made from any suitable material, such as plastic. The ribs 8 may be removable, or the pockets can be sewn shut to permanently retain the ribs. When equipment is placed in the accessory bag and the accessory bag is rolled to have the appropriate length for the size of the equipment, the equipment cannot move within the accessory bag. The equipment and ribs 8 cooperate to provide structural integrity to the accessory bag so that, even though the accessory bag is made of flexible material, the accessory bag can be rolled on the wheels 24.

Figure 6:
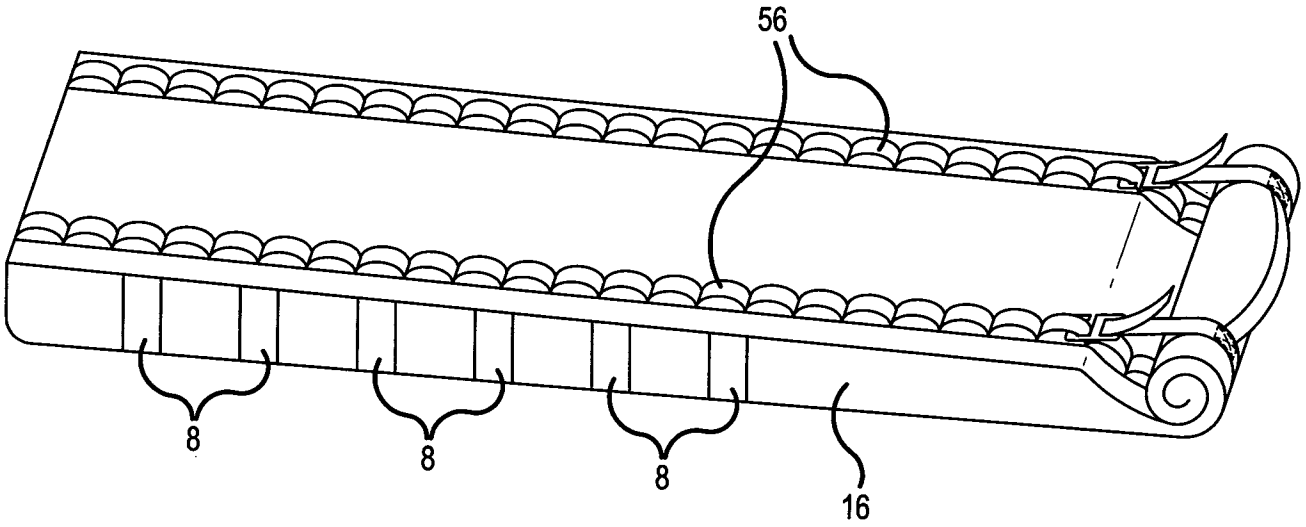
FIG. 6 is a perspective view of the accessory bag partially rolled with a connection handle attached.

FIG. 6 is similar to FIG. 5, but shows the front panel 52 in a closed position and the connection handle 40 attached to both connection rails 56, 66 in order to maintain the bag in the partially rolled position. The connection handle 40, to be explained in more detail later, has a pair of adjustable G-shaped buckles 48 engaging a loop of the first pair of connection rails 56. The buckles are connected to straps 42, 44 with a similar buckle 48, preferably non-adjustable, on the opposite end engaging a loop on the second pair of connection rails 66. A handle 46 extends between the two straps 42, 44 to provide a convenient place for grasping by the user and to form the connection handle into a single piece. The buckles 48 can be attached to any loop that is convenient depending on the extent the accessory bag has been rolled. In addition, the adjustable buckles 48 can be adjusted to ensure that rolled portion of the top 22 of the accessory bag is tight, so that the equipment inside the accessory bag forms a rigid structure with the bag.

Figure 7:
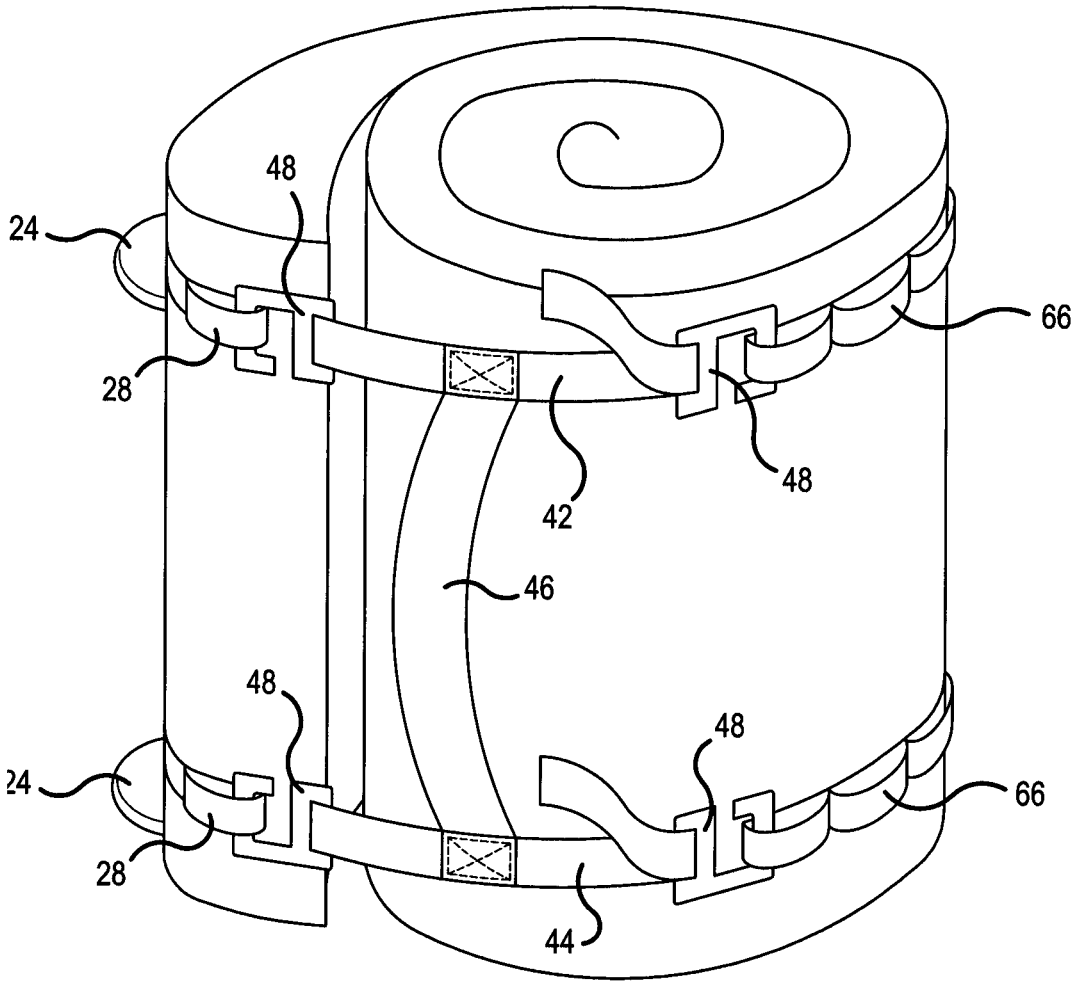
FIG. 7 is a perspective view of the accessory bag fully rolled.

FIG. 7 shows the accessory bag in the fully rolled position. To completely roll the bag, the front panel 52 can be opened, allowing the side walls 16 to collapse onto the back wall 14. This creates a substantially flat configuration to facilitate rolling. In the fully rolled position, the back wall 14 forms the exterior of the roll. Therefore, only the second pair of connection rails 66 are accessible. The connection handle 40 is connected to a loop of the pair of second connection rails 66 with the adjustable buckle being connected to the loop 28 provided on the bottom wall 20 of the bag, as was discussed earlier with reference to FIG. 3. In this configuration, the connection handle 40 maintains the rolled state of the accessory bag and provides a handle 46 for easy transport of the accessory bag.

Figure 8:
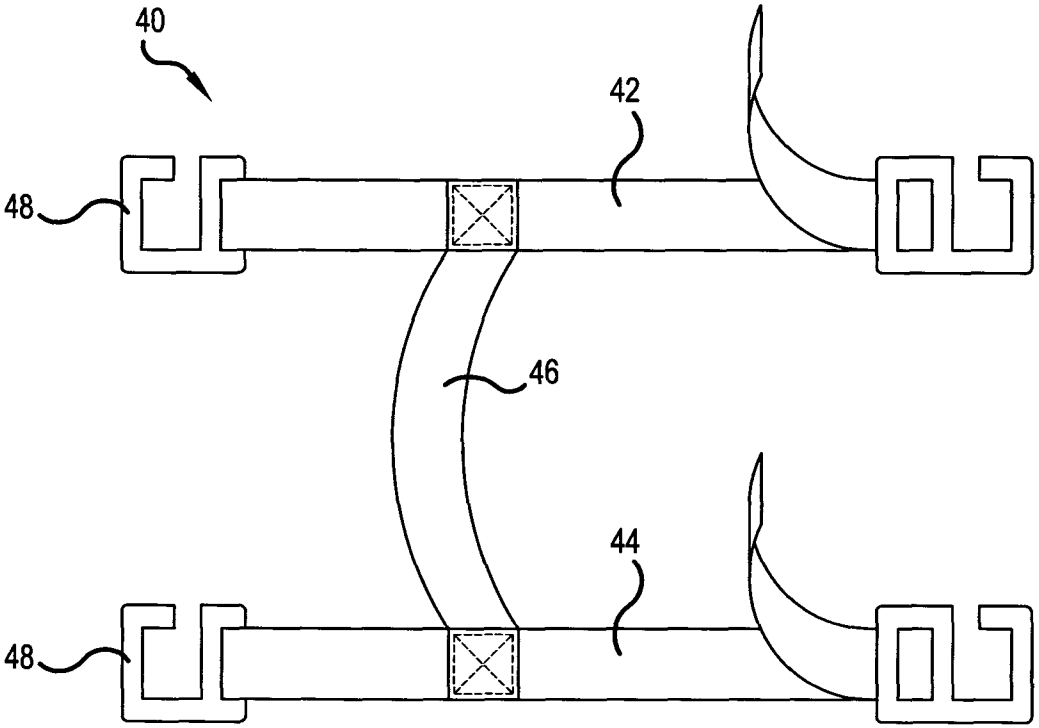
FIG. 8 depicts the connection handle.

FIG. 8 shows the connection handle 40 having a pair of straps 42, 44. The connection handle 40 has a first end provided with connectors that are fixed to the straps 42, 44 and a second end having connectors that are adjustably connected to the straps. A G-shaped buckle 48 used as the connector is provided on each end of the strap 42, 44. While a G-shaped buckle is shown, any suitable connector for mating with the connection rails may be used. A handle 46 extends between the two straps 42, 44 to provide a convenient grasping point for the user and to connect the two straps 42, 44 together to form a single piece. In addition, a shoulder strap (not shown) can be attached to the connection handle 40 for added convenience of the user.

While the invention has been described with reference to a preferred embodiment, variations and modification would be apparent to one of ordinary skill in the art. The invention encompasses such variations and modifications.

I claim:

1. An accessory bag, comprising:

a bottom wall, a front wall and a back wall, the wall being made of flexible material;

a pair of side walls extending between the front wall and back wall;

at least one front connection rail extending along the front wall;

at least one back connection rail extending along the back wall; and a connection handle comprising:

a first end and a second end;

a first connector on the first end configured to cooperate with the at least one front connection rail;

a second connector on the second end configured to cooperate with the at least one back connection rail;

a handle; and at least one connector on the bottom wall, the at least one connector configured to cooperate with the first connector.

2. The accessory bag of claim 1, wherein the at least one front connection rail comprises a plurality of loops extending from the front wall.

3. The accessory bag of claim 2, wherein the at least one back connection rail comprises a plurality of loops extending from the back wall.

4. The accessory bag of claim 3, wherein the connection handle comprises:

a first strap having a first end at a first end of the connection handle and second end at a second end of the connection handle;

the first connector and the second connector attached to the first end and the second end of the first strap, respectively;

a second strap having a first and second end, the second strap being parallel to the first strap;

a third connector and a fourth connector attached to the first end and the second end of the second strap, respectively, wherein the handle extends between the first and second straps.

5. The accessory bag of claim 1, wherein the connection handle comprises:

a first strap having a first end at a first end of the connection handle and second end at a second end of the connection handle;

the first connector and the second connector attached to the first end and the second end of the first strap, respectively;

a second strap having a first and second end, the second strap being parallel to the first strap;

a third connector and a fourth connector attached to the first end and the second end of the second strap, respectively, wherein the handle extends between the first and second straps.

6. The accessory bag of claim 1, further comprising wheels attached to the bottom wall.

7. The accessory bag of claim 1, further comprising reinforcing ribs in the side walls.

8. The accessory bag of claim 1, wherein the at least one back connection rail aligns with the at least one front connection rail when the bag is adjusted in length.

9. The accessory bag of claim 1, wherein the at least one front connection rail is a first pair of connection rails and the at least one back connection rail is a second pair of connection rails.

10. The accessory bag of claim 1, wherein the first connector and second connector releasably attach the connection handle to the bag.

11. The accessory bag of claim 1, wherein each of the third connector and the fourth connector is a loop.

12. An accessory bag, comprising:

a bottom wall, a front wall, a back wall, and a top between the front wall and the back wall;

a pair of side walls extending between the front wall and back wall;

at least one front connection rail extending along a length of the front wall in a direction between the bottom wall and the top;

at least one back connection rail extending along a length of the back wall in a direction between the bottom wall and the top, wherein each of the connection rails is connected to the bag at a plurality of attachment points to form a plurality of loops between the connection points.

13. The accessory bag of claim 12, wherein the at least one front connection rail is a first pair of connection rails and the at least one back connection rail is a second pair of connection rails.

14. The accessory bag of claim 12, wherein the connection handle comprises:

a first strap having a first end at a first end of the connection handle and second end at a second end of the connection handle;

the first connector and the second connector attached to the first end and the second end of the first strap, respectively;

a second strap having a first and second end, the second strap being parallel to the first strap;

a third connector and a fourth connector attached to the first end and the second end of the second strap, respectively, wherein the handle extends between the first and second straps.

15. The accessory bag of claim 12, wherein the connection handle comprises:

a first strap having a first end at a first end of the connection handle and second end at a second end of the connection handle;

the first connector and the second connector attached to the first end and the second end of the first strap, respectively;

a second strap having a first and second end, the second strap being parallel to the first strap;

a third connector and a fourth connector attached to the first end and the second end of the second strap, respectively, wherein the handle extends between the first and second straps.

16. The accessory bag of claim 12, further comprising wheels attached to the bottom wall.

17. The accessory bag of claim 12, further comprising reinforcing ribs in the side walls.

18. The accessory bag of claim 12, wherein the at least one back connection rail aligns with the at least one front connection rail when the bag is adjusted in length.

19. The accessory bag of claim 12, wherein the first connector and second connector releasably attach the connection handle to the bag.

20. The accessory bag of claim 12, wherein each of the third connector and the fourth connector is a loop.

* * * * *